United States Patent [19]

Fleury

[11] 4,377,770

[45] Mar. 22, 1983

[54] MICROWAVE DELAY LINE INCORPORATING A CONDUCTOR WITH A VARIABLE CROSS-SECTION FOR A TRAVELLING-WAVE TUBE

[75] Inventor: Georges Fleury, Paris, France

[73] Assignee: Thompson-CSF, Paris, France

[21] Appl. No.: 152,173

[22] Filed: May 22, 1980

[30] Foreign Application Priority Data

May 23, 1979 [FR] France ..... 79 13198

[51] Int. Cl.[3] ..... H01J 25/34

[52] U.S. Cl. ..... 315/3.6; 315/3.5; 315/39.3

[58] Field of Search ..... 315/3.5, 3.6, 39.53, 315/39.3

[56] References Cited

U.S. PATENT DOCUMENTS

| | | | |
|---|---|---|---|
| 2,541,843 | 2/1951 | Tiley | 315/3.6 |
| 2,637,775 | 5/1953 | Lund | 315/3.6 |
| 2,922,068 | 1/1960 | Kennedy | 315/3.6 |
| 3,735,188 | 5/1973 | Anderson et al. | 315/3.6 |
| 4,229,676 | 10/1980 | Manoly | 315/3.6 |

*Primary Examiner*—Saxfield Chatmon, Jr.
*Attorney, Agent, or Firm*—Roland Plottel

[57] ABSTRACT

A helical microwave delay line for a travelling-wave tube, constituted by a conductor held in the envelope of the tube by insulating bars. The width of the conductor in contact with the supporting bars increases along the tube axis, particularly towards the microwave energy output.

8 Claims, 5 Drawing Figures

FIG_3-a
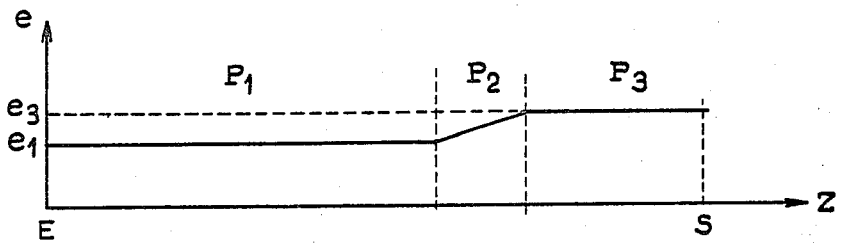
FIG_3-b
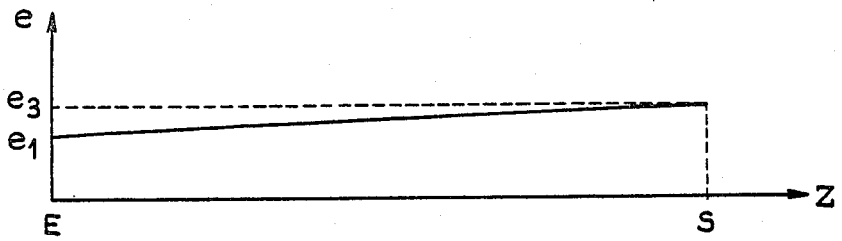
FIG_3-c
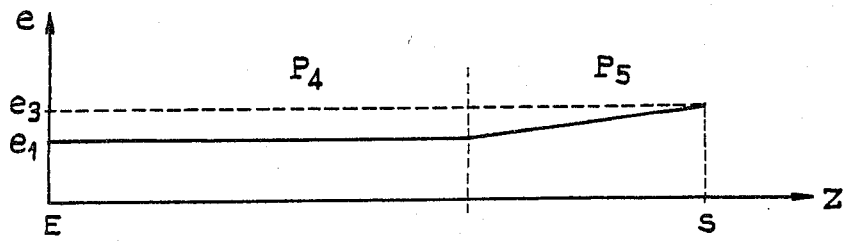

MICROWAVE DELAY LINE INCORPORATING A CONDUCTOR WITH A VARIABLE CROSS-SECTION FOR A TRAVELLING-WAVE TUBE

BACKGROUND OF THE INVENTION

The present invention relates to a microwave delay line for a travelling-wave tube incorporating an electrical conductor, whose geometry varies only along the axis of the tube.

As is known, a travelling-wave tube is constituted by the association of a long thin electron beam with a non-resonant delay line having a periodic structure. The electrons of the beam supply energy to the microwave travelling along the line when certain conditions of synchronism exist between the wave and the beam. The delay line is generally constituted by a helix, or a circuit derived from a helix. The electrons are transmitted in accordance with the helix axis, which is also the tube axis. Circuits derived from helix, include the multiple conductor helix having two intertwined leads, a counter-helix or its topological equivalents, or the ring and bar or ring and loop circuit, or a microwave structure whose mechanical connection to the tube envelope is provided by quarter wavelength metal supports. For simplicity in the detailed description, the delay lines hereinafter will be a simple helix.

In the prior art, the electrical efficiency of a travelling-wave tube is an increasing function of the coupling impedance between the electron beam and the delay line. This has led to a maximum desired coupling impedance. It is obtained by a width of conductor wire constituting a simple helix approximately equal to half the helix pitch. The width being constant along the tube axis.

BRIEF SUMMARY OF THE INVENTION

It is an object of the invention to provide an ultra-high frequency delay line. The line, when in a travelling wave tube, improves the electrical efficiency of the tube and permits an increase in the output power of the tube (for a structure of given dimensions): The electrical conductor constituting the delay line has a geometry which varies along the tube axis and more specifically a width which increases, particularly towards the microwave output.

BRIEF DESCRIPTION OF THE DRAWINGS

The invention is described in greater detail hereinafter in the embodiments and the drawings, which show:

FIGS. 3*a* to 3*c* are diagrams illustrating the evolution of the width of the conductor constituting the helix according to the invention.

DETAILED DESCRIPTION OF THE PREFERRED EMBODIMENTS

Figure 1:
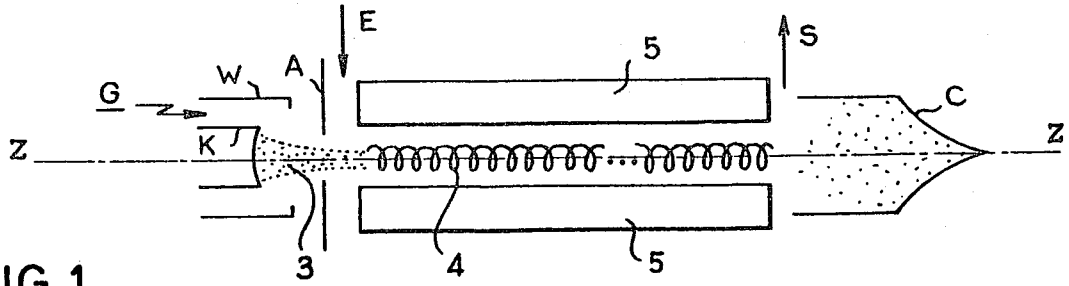
FIG. 1 is a diagram of a travelling-wave tube incorporating a helical delay line.

In the drawings, the same references are used to designate the same elements.

FIG. 1 shows an electron gun G, constituted by a cathode K emitting an electron beam 3 in a direction ZZ, a WEHNELT type controlled electrode W, and an anode A. It also shows a delay line 4, which for example has a cylindrical helical shape of axis ZZ surrounding the electron beam 3 (during its travel in line 4) and a beam electron collector C. The device also has an input E and an output S for the microwave energy travelling along line 4. These various components are contained in an air tight envelope or sleeve, which is not shown in the drawing and has a generally cylindrical shape of axis ZZ.

The operation of this device is briefly described. The velocity of the electrons of beam 3 is modulated periodically by a field in relation to the wave propagating along the delay line 4. Under the influence of this velocity modulation, the electrons are grouped into clusters, and there is an energy transfer from the electron clusters to the wave propagating along the line when a certain synchronism condition is satisfied between the electron velocity and one of the phase velocities of the wave travelling along the line. In the case of a cylindrical helix, it is known to obtain this synchronism by variations in the helix pitch.

Figure 2:
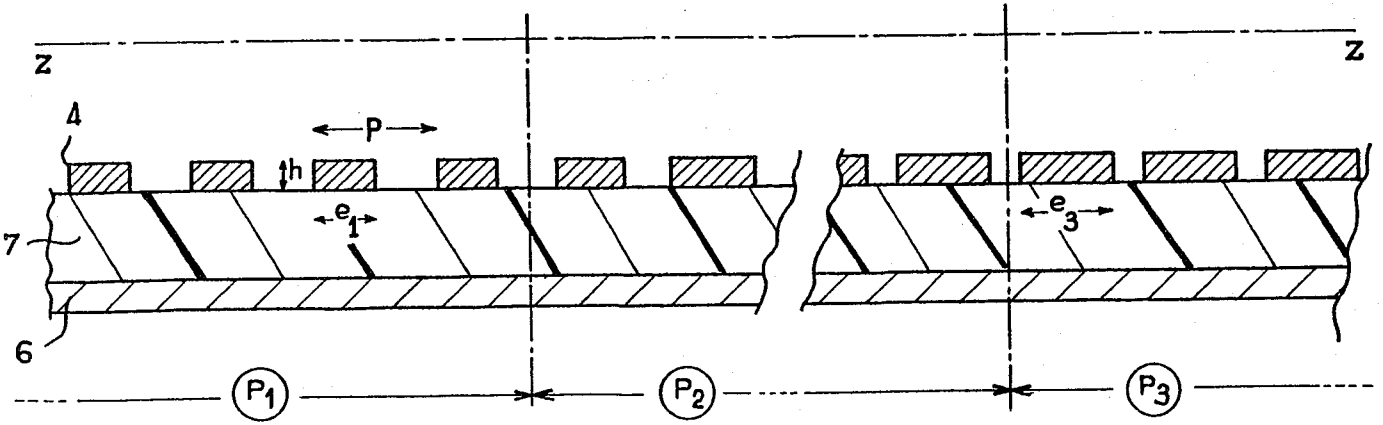
FIG. 2 is part of the longitudinal section of the tube according to the invention.

FIG. 2 is a partial longitudinal section (along the axis ZZ) of an embodiment of the tube according to the invention. FIG. 2 shows the axis ZZ, the cylindrical envelope 6 of the tube and the helix 4 of the delay line. The turns of helix 4 are shown in section; also shown in cross-section is one of several insulating bars 7 which support the helix 4 in the envelope 6.

The electrical conductor constituting the helix 4 has for example a rectangular cross-section. According to the invention, this cross-section varies along the tube axis, and this variation is obtained in the following manner:

In a first portion $P_1$, the cross-section of the conductor is constant and for example rectangular, the dimensions being designated by $e_1$ for the side parallel to the axis ZZ, in contact with the bar 7, and h for the other side.

In the following portion of the line $P_2$ the cross-section of the conductor increases, preferably by a progressive increase in the length $e_2$ of the side in contact with bar 7, height h remaining constant.

In the last part of the line on the side of the microwave energy output S, designated by $P_3$ in FIG. 2, the cross-section of the conductor constituting the helix is constant and is defined by the same height h and a width $e_3$.

In part $P_1$, the ratio is $e_1/p$, p is the helix pitch and is such that the coupling impedance is at a maximum. This part constitutes essentially two thirds or three quarters of the delay line. The function of part $P_2$ is to bring about a progressive increase in the width of the conductor so as to prevent mismatches due to too rapid variations of the line impedance. In part $P_3$, the width $e_3$ is at a maximum. For example, the ratio of the width of the wire on the helix pitch is approximately 0.5 for part $P_1$ and can reach 0.8 for part $P_3$.

Moreover and in order to simplify the diagram, FIG. 2 shows a constant pitch (p) for the helix. Obviously, and as is known, this can vary and increase for example towards the tube output S which leads to a greater increase in the wire width in part $P_3$.

FIGS. 3 show diagrams illustrating the development of the width e of the conductor along the axis ZZ of the tube.

The diagram of FIG. 3*a* shows a thickness development corresponding to FIG. 2. The abscissa shows the axis Z between input E and output S of the tube, and the ordinate shows the width (e) of the conductor. At input E, this width is equal to $e_1$ and remains constant over most ($P_1$) of the line. At the tube output S (part $P_3$) this thickness is at a maximum and equal to $e_3$, while between them in intermediate part $P_2$. The thickness progressively increases, for example in linear manner from $e_1$ to $e_3$.

The diagram of FIG. 3*b*, which is identical to that of FIG. 3*a*, illustrates a variant of the delay line according to the invention in which the thickness of the conductor increases in a substantially linear manner from input E, where it is equal to $e_1$ to output S, where it is equal to $e_3$.

This variant has the advantage of simplicity, but it does not make it possible to obtain a maximum coupling impedance over a sufficient length at the start of the tube and this is disadvantageous, as will be described hereinafter.

The diagram of FIG. 3*c* shows another variant in which the variation of the thickness of the conductor takes place in only two stages. Namely, in a first part ($P_4$) of the tube the conductor has a constant thickness $e_1$ as in the case of FIG. 3*a* and in the second part ($P_5$) the thickness of the conductor varies, for example in linear manner between $e_1$ and $e_3$, so as to be at a maximum ($e_3$) at the tube output. This is a compromise between the structures illustrated in FIGS. 3*a* and 3*b*.

The conductor forming the delay line can advantageously be of copper. It is produced by cutting its constant width part or parts and adjusting by means of a gauge its variable width part. It is preferably brazed to supports 7.

As stated hereinbefore, the present structure makes it possible to improve the electrical efficiency of a travelling-wave tube. Thus, the microwave losses are lower than in a prior art delay line structure for which the conductor cross-section is constant. This is because the microwave currents are distributed over a larger conductive surface. Moreover, calculations and tests performed by the Applicant have shown that contrary to what was thought before, the electrical efficiency of such a tube is not an increasing function of the coupling impedance over the entire tube length, and in fact a reduction in the coupling impedance at the end of the delay line improves this electrical efficiency.

In addition, this structure makes it possible to improve the removal of heat. It is known that the thermal power to be dissipated increases greatly at the end of the line. The increase in the width of the conductor forming the line makes it possible to increase the passage cross-section of the thermal flux in the supports of the line, so that more thermal power is dissipated for a given maximum helix temperature. Thus, for a given structural dimension of the beginning of the line, the output power of the tube can be increased compared with the prior art.

Finally, it is known that the electron beam is more divergent at the end of the line and therefore the parasitic bombardment of the line by electrons is greater at that end. However, in the structure according to the invention, the conductor is wider at the end of the line, so that the coil is more robust and there is a reduction in the risks of fusion due to this electron bombardment.

The above description has been given in the case of a helical and cylindrical delay line. However, it also applies to lines with a variable pitch, as well as to other microwave structures of the type referred to hereinbefore or, for example, as described in French Patent Application 76-28394 (publication No. 2,365,218) and its Addition 77-28741 in the name of THOMSON-CSF.

What is claimed is:

1. A travelling-wave tube comprising in a vacuum envelope; an electron gun for producing an electron beam; a delay line substantially co-axial with the electron beam for propagating a microwave interacting with said beam between an input and output of the tube, said delay line comprising a substantially helical shaped conductor, the cross section of which is greater at the output end of the helix than at the input end, and the increase occurs gradually with the turns closer to the output wherein the output turns are equal to or larger than the preceding turns, and with at least one fourth of the turns of the helix being greater in cross-section than those of the smallest turns.

2. A tube according to claim 1, wherein said conductor cross-section increases at the output end of the line.

3. A tube according to claim 1, wherein said delay line comprises at least three parts, said conductor having a constant cross-section in the first and third of said three parts taken in the propagation direction of said microwave and the conductor cross-section is greater in the third of said three parts than in said first part, the transition between the two being provided by the second of said three parts.

4. A tube according to claim 1, wherein the cross-section of said conductor taken along the axis of said tube, is substantially rectangular with two sides of said rectangle parallel to said tube axis, the length of said two sides varying along said axis.

5. A tube according to claim 4, wherein the ratio of said length to the pitch of said helix is increasing towards the output end of the tube, and is comprised between 0.5 and 0.8.

6. A tube according to claim 1, further comprising supports for said line in said envelope, and in contact with said helix, said delay line cross-section comprising the surface area of said conductor which is in contact with said supports and which varies along said axis.

7. A tube according to claim 4, wherein the ratio of said length to the pitch e/p of said helix is increasing towards the output end of the tube.

8. A travelling wave tube comprising in a vacuum envelope; an electron gun for producing an electron beam; a delay line substantially coaxial with the electron beam for propagating a microwave interacting with said beam between an input and an output of the tube; said delay line comprising a substantially helical shaped conductor whose cross-section area on the outer surface thereof is greater at the output end of the helix than at the input end, and the increase occurs gradually with the turns closer to the output wherein the output turns are equal to or larger than the preceding turns, and with at least one fourth of the turns of the helix being greater in cross section than those of the smallest turns.

* * * * *